US009738007B2

(12) United States Patent
Shimamura

(10) Patent No.: US 9,738,007 B2
(45) Date of Patent: Aug. 22, 2017

(54) ELECTRIC STAPLER

(75) Inventor: Masashi Shimamura, Tokyo (JP)

(73) Assignee: MAX CO., LTD., Tokyo (JP)

( * ) Notice: Subject to any disclaimer, the term of this patent is extended or adjusted under 35 U.S.C. 154(b) by 896 days.

(21) Appl. No.: 12/858,966

(22) Filed: Aug. 18, 2010

(65) Prior Publication Data

US 2011/0057015 A1 Mar. 10, 2011

(30) Foreign Application Priority Data

Sep. 8, 2009 (JP) ..... 2009-207154

(51) Int. Cl.
*B25C 1/06* (2006.01)
*B27F 7/19* (2006.01)

(52) U.S. Cl.
CPC ..... *B27F 7/19* (2013.01)

(58) Field of Classification Search
USPC ..... 227/2, 155, 131, 142, 156; 270/58.08
See application file for complete search history.

(56) References Cited

U.S. PATENT DOCUMENTS 4,720,033 A * 1/1988 Olesen ..... 227/131
5,141,143 A * 8/1992 Ebner et al. ..... 227/129
5,799,935 A 9/1998 Yamanushi et al.
5,806,750 A * 9/1998 Yamanushi et al. ..... 227/155
5,823,415 A * 10/1998 Udagawa et al. ..... 227/120
6,565,075 B2 * 5/2003 Ishizaki ..... 270/58.09

FOREIGN PATENT DOCUMENTS

EP 1 136 208 A1 9/2001
EP 1 733 856 A1 12/2006
JP 49-44316 U 4/1974
JP 49-443160 U 4/1974
JP 7-215565 8/1995
JP 9-048556 A 2/1997

* cited by examiner

*Primary Examiner* — Nathaniel Chukwurah
(74) *Attorney, Agent, or Firm* — Drinker Biddle & Reath LLP

(57) ABSTRACT

An electric stapler is provided with: a base (B); and a stapler main body (1) arranged on the base (B). The stapler main body (1) is provided with: a driver unit (2) including a driver for driving a staple (S) to pierce through sheets of paper (P); a clincher unit (3) including a clincher for clinching the driven staple; and a table (4) provided on one of the driver unit (2) and the clincher unit (3). The stapler main body (1) is supported to be displacable with respect to the base (B). The table (4) is configured to be movable between a first position and a second position apart from the first position in a direction where the driver drives the staple, in accordance with a displacement of the stapler main body (1) with respect to the base (B).

11 Claims, 12 Drawing Sheets

ELECTRIC STAPLER

BACKGROUND OF THE INVENTION

Field of the Invention

The present invention relates to an electric stapler in which a level difference produced between a guide plate that feeds sheets of paper from a paper processing equipment provided in an image forming apparatus such as a copying machine or a printer to a stapler main body and a table provided on the stapler main body is eliminated.

Related Art

A stapler, equipped in a paper processing equipment provided in an image forming apparatus such as a copying machine or a printer, bounds a plurality of sheets as one set. A stapling action is carried out in such a manner that the sheets fed from the copying machine side are put on a guide plate, then the sheets are fed to a table provided to the stapler, and then the staple is driven into the sheets on the table. In order to align edges of the sheets, a receiving plane to which the edge of the sheets hits must be formed on the guide plate. Also, in order to feed the sheets to the table, a top end of the guide plate must be set at least on the table. However, if the guide plate is set directly on the table, the stapling action cannot be carried out owing to a hindrance of the guide plate. For this reason, an opening portion is formed in the guide plate by notching a portion corresponding to the table of the stapler, and the sheets are fed onto the table of the stapler in a state that the sheets on the guide plate are exposed from the opening portion. Also, there are a two-location binding and a corner binding as the stapler function. In order to respond to these modes, the opening portion is formed in the positions corresponding to the stapling locations respectively, then the guide plate is provided at a height that is contained in a space between the driver and the clincher of the stapler, then the stapler is moved up to the position of the opening portions in the guide plate along the side surface of the guide plate, and then the stapling action is performed.

Here, the table acts as a platform that is fixed on the stapler main body to staple the sheets. For example, in an apparatus in which the driver is driven to come close to the clincher fixed to the stapler main body, to perform the stapling action, the table is provided on a side of the clincher. When the driver comes close to the clincher, the sheets are pushed against a top surface of the table by the driver, and then the staple is driven toward clincher.

Meanwhile, when respective heights of a loading surface of the guide plate and the table of the stapler are different, the sheets on the guide plate are brought into a floating state over the table of the stapler. Therefore, when particularly a bundle of the sheets is thick, the bundle itself has rigidity and thus a bottom of the sheets cannot be firmly pushed against the table of the stapler in the stapling action. As a result, it is possible that the stapling failures are caused, e.g., a crown portion of the staple is lifted up from a surface of the sheets, a clinching of legs of the staple becomes insufficient, and the like.

As the measure taken against these failures, such an approach may be considered that the guide plate with small rigidity is arranged such that the guide plate is bent in the stapling action to bring the sheets into contact with the table of the stapler. However, when the guide plate with small rigidity is arranged, the guide plate itself is bent by a weight of the sheets if the number of sheets is large, so that a risk of a collision of the stapler main body with the guide plate is increased when the stapler is moved. Also, when the guide plate is set in a higher position than the table of the stapler to avoid such collision, such a problem arises that a space through which the sheets are inserted in the stapling action is decreased and thus a transfer of the sheets is disturbed.

As another measure, a technology to construct the stapler movably in a vertical direction and perform the stapling action after the table and the loading surface of the guide plate are set to constitute a substantially coplanar plane is known (see JP-A-07-215565).

However, according to the above technology, the stapler must be moved in not only a lateral direction but also the vertical direction. Therefore, a moving mechanism for moving the stapler is required on an outside of the stapler, so that such a situation cannot be avoided that an overall apparatus is made complicated and is increased in size.

SUMMARY OF THE INVENTION

One or more embodiments of the invention provide an electric stapler capable of causing a table and a loading surface of a guide plate to constitute a substantially coplanar plane in a stapling action, by utilizing a driving force for the stapling action of the stapler, without a particular device.

In accordance with one or more embodiments of the invention, an electric stapler is provided with: a base B; and a stapler main body 1 arranged on the base B and including a driver unit 2 having a driver for driving a staple S to pierce through sheets of paper P, a clincher unit 3 having a clincher for clinching the driven staple, and a table 4 provided on one of the driver unit 2 and the clincher unit 3 and on which the sheets P are supported during a stapling action. The stapler main body 1 is supported to be displacable with respect to the base B. The table 4 is configured to be movable between a first position and a second position apart from the first position in a direction where the driver drives the staple, in accordance with a displacement of the stapler main body 1 with respect to the base B.

An electric motor M configured to drive both the driver unit 2 and the clincher unit 3 may be mounted within the stapler main body 1. A displacement movement of the stapler main body 1 with respect to the base B may be powered by said electric motor M. The electric motor M may be arranged within the stapler main body 1 so that a whole of the electric motor M is also displaceable with respect to the base B in accordance with the displacement movement of the stapler main body 1.

The stapler main body 1 may be configured to displace with respect to the base B in accordance with the stapling action of the driver unit 2 or the clincher unit 3.

According to this structure, the stapler main body is displaced with respect to the base by utilizing the stapling action of the driver unit or the clincher unit such that the table of the stapler main body moves. Therefore, the sheets can be clamped in the stapling action, without a particular mechanism, such that the table of the stapler moves by utilizing the driving force required for the stapling action of the stapler merely in the situation that the stapler main body is supported to displace with respect to the base. As a result, the overall stapler can be held compactly, and the satisfactory stapling action can always be done while eliminating a level difference between the table and the sheets at a low cost.

In the above structure, the stapler main body 1 may be displaced by a clamping action in which the sheets P are clamped by bringing the clincher unit 3 close to the driver unit 2 in the stapling action.

According to this structure, by continuing to apply a power to bring the clincher unit close to the driver to clamp the sheets, the stapler main body equipped with the table is displaced. As a result, the sheets can be clamped without fail, and the stapling action can be done satisfactorily.

In the above structure, a cam 22 may be arranged on a driving shaft 21 provided on said one of the driver unit 2 and the clincher unit 3 on which the table 4 is provided. A cam follower 24 may be provided on the base B and engaged with the cam 22. The stapler main body 1 may be displaced with respect to the base B by rotating the cam 22 to change a distance between the driving shaft 21 and the cam follower 24.

According to this structure, the cam is provided on the driving shaft, and the cam follower is provided to the base. Then, the stapler main body is displaced with respect to the base by rotating the cam to engage with the cam follower. As a result, the sheets can be clamped without fail, and the stapling action can be done satisfactorily.

In the above structure, the driver D drives the U-shape staple S toward the sheets P in a first direction, the U-shape staple S includes a crown portion C extending in a second direction which is perpendicular to the first direction and leg portions L extending in the first direction from both ends of the crown portion C, and the stapler main body 1 may be supported swingably with respect to the base B around a rotating shaft 15 disposed on an opposite side to the table 4 in a third direction which is perpendicular to both the first direction and the second direction.

According to this structure, the displacement is caused by the portion, which is located on the opposite side to the table and rotatably supported by the base, of the stapler main body. Therefore, the position of the rotating shaft is provided in the substantially same height position as the table, and respective positions of the clinching portion and the driver unit are seldom displaced even when the stapler main body is turned/displaced. As a result, the stapling action can be done without fail.

In the above structure, the stapler main body 1 may be supported to displace with respect to the base B in a manner of a parallel translation in a direction in which the driver D drives the staple S toward the sheets P.

According to this structure, the displacement is caused by translating the stapler main body with respect to the base. Therefore, respective positions of the clinching portion and the driver unit are seldom displaced even when the stapler main body is displaced. As a result, the stapling action can be done without fail.

In the above structure, a projection portion 27 may be formed on a cam 30 arranged on a driving shaft 21 provided on said one of the driver unit 2 and the clincher unit 3 on which the table 4 is provided. A cam follower 28 that is engagable with the projection portion 27 may be provided to the base B. The cam follower 28 may be engaged with the projection portion 27 in a standby state to restrict a displacement of the stapler main body 1.

According to this structure, when the stapling action is ended, the projection portion of the cam engages with the cam follower, and the stapler main body is brought into the standby state. At this time, the stapler main body cannot be displaced, and is brought into the stable state. Since the cam is turned together with the driving shaft in the stapling action and thus the cam follower is released from the projection portion, the stapler main body is brought into a displaceable state. When the stapling action is ended, the projection portion of the cam engages with the cam follower again. Thus, the displacement of the stapler main body toward the upper side is restricted, and the stapler main body is brought into the stable state. Since the stapling action in one cycle is performed every turn of the driving shaft, the stapler main body can be stabilized by engaging the projection portion of the cam with the cam follower at the timing at which the stapler main body returns to its standby state after the stapling action is ended.

Other aspects and advantages of the invention will be apparent from the following description and the appended claims.

DETAILED DESCRIPTION OF THE EXEMPLARY EMBODIMENTS

First Exemplary Embodiment

Figure 1:
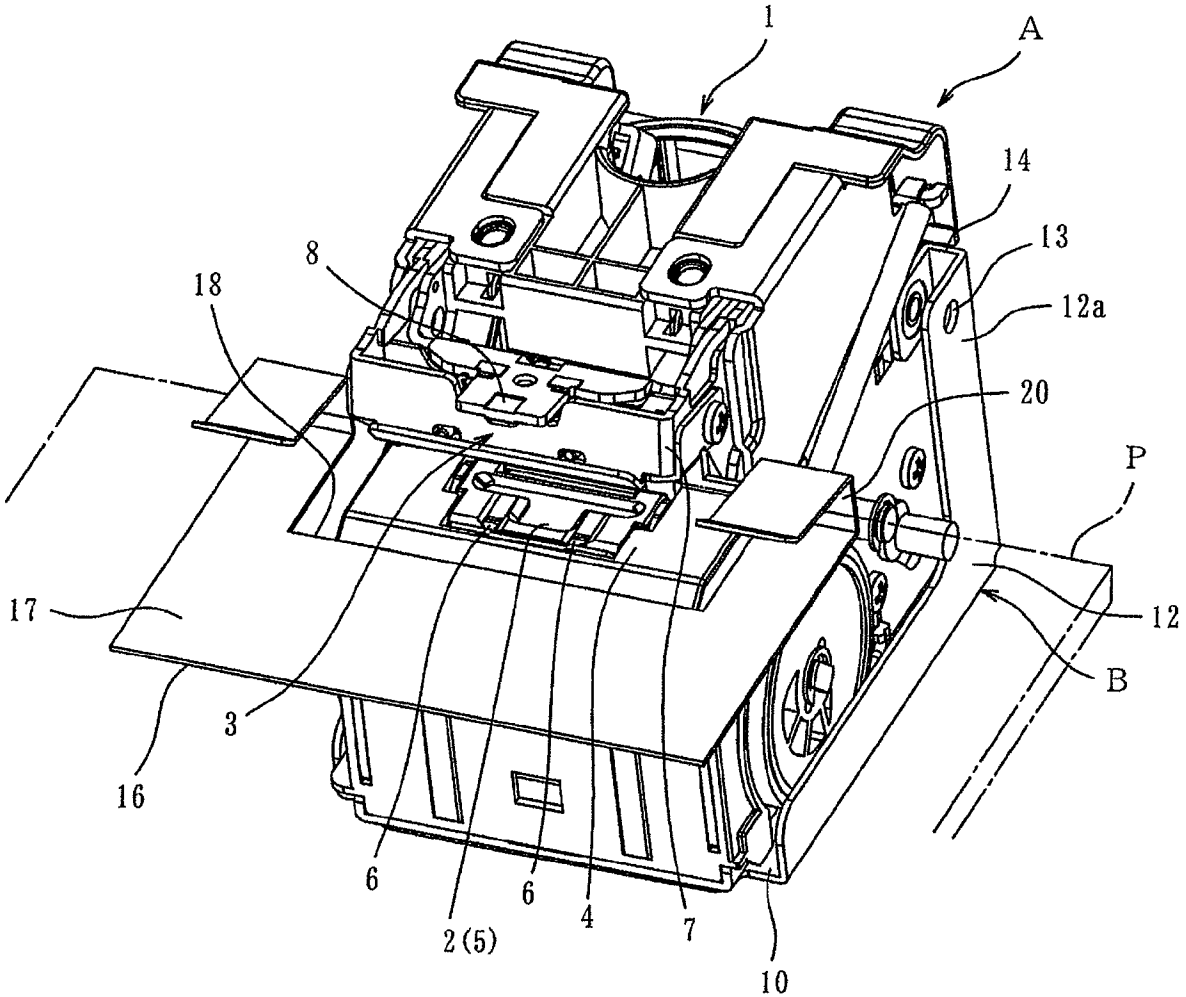
FIG. 1 is a schematic perspective view showing a basic configuration of an electric stapler of a first exemplary embodiment.

FIG. 1 is a perspective view of an electric stapler A of a first exemplary embodiment. The electric stapler A is provided to a paper processing equipment acting as a paper post processing equipment that is provided at a latter stage of an image forming apparatus such as a copying machine or a printer, or the like. The electric stapler A includes a base B. The base B is arranged on a frame member of the paper post processing equipment. In order that a plurality of portions along an edge of sheets of paper P can be stapled by the single electric stapler A, the base B is disposed so as to be movable with respect to the frame member of the paper processing equipment in a direction along the edge of the sheets P (that is, right/left direction=second direction). (In addition, the base B may be further movable in a direction close-toward/apart-from the edge of the sheets (that is, front/rear direction=third direction). Further, the base B may be fixed to the frame member of the paper processing equipment.) A stapler main body 1 is arranged on a base B. A driver unit 2 is provided to the stapler main body 1. Also, a clincher unit 3 is provided to the stapler main body 1 to swing in a vertical direction such that the clincher unit 3 moves toward/away from the driver unit 2 according to the swinging action. A table 4 is provided to the driver unit 2.

A head portion 5 constructed such that a cartridge (not shown) including connected straight staples can be detachably attached to this portion is provided to the stapler main body 1. The head portion 5 forms the straight staple sent out from the cartridge, and then drives out this shaped stapler. The driver unit 2 for driving both a forming plate (not shown) for forming the straight staple into U-shape and a driver for driving out the U-shape staple is provided to the head portion 5. The straight staples in the cartridge are fed sequentially to the driver unit 2.

Figure 12:
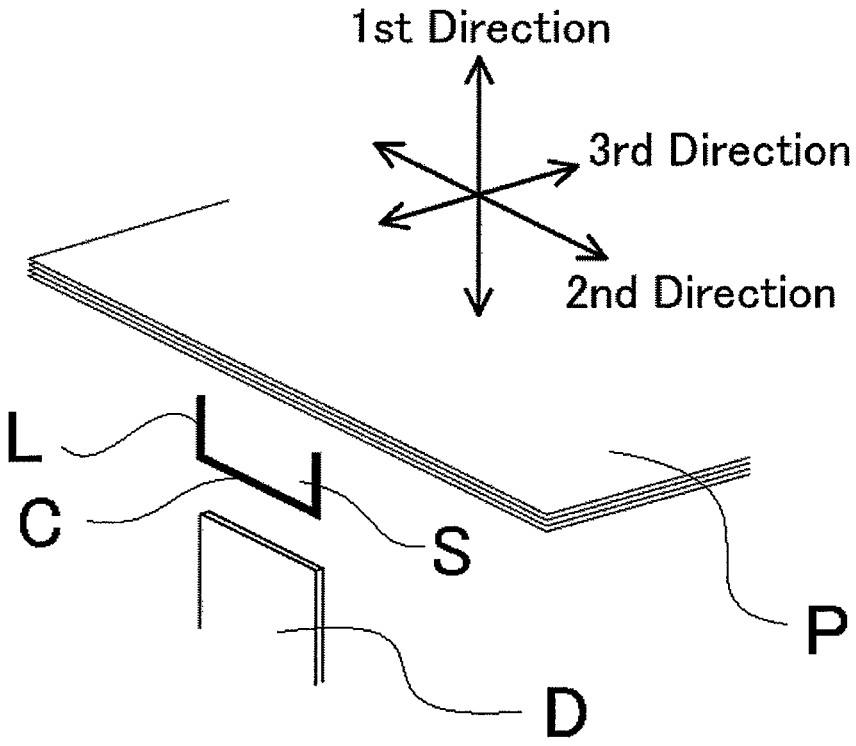
FIG. 12 is a drawing for showing directions.

As shown in FIG. 12, when the direction (up/down direction) in which the driver D drives the U-shape staple S toward the sheets P is defined as a first direction, the U-shape staple S includes a crown portion C extending in a second direction (right/left direction) which is perpendicular to the first direction and leg portions L extending from both sides of the crown portion C in the first direction. Further, the direction (front/rear direction) which is perpendicular to both the first direction and the second direction is a third direction.

The table 4 serves as a table that supports portions to be stapled of the sheets from a bottom side of the sheets, and is provided around a staple driving portion 6 provided on an upper surface of the head portion 5.

A movable clincher for clinching the leg portions of the staple driven by the driver and its driving mechanism are provided in the clincher unit 3. The movable clincher is provided on a clinching portion 8 that is provided on an end of a drive link 7 which is swingably to the stapler main body 1.

Figure 2:
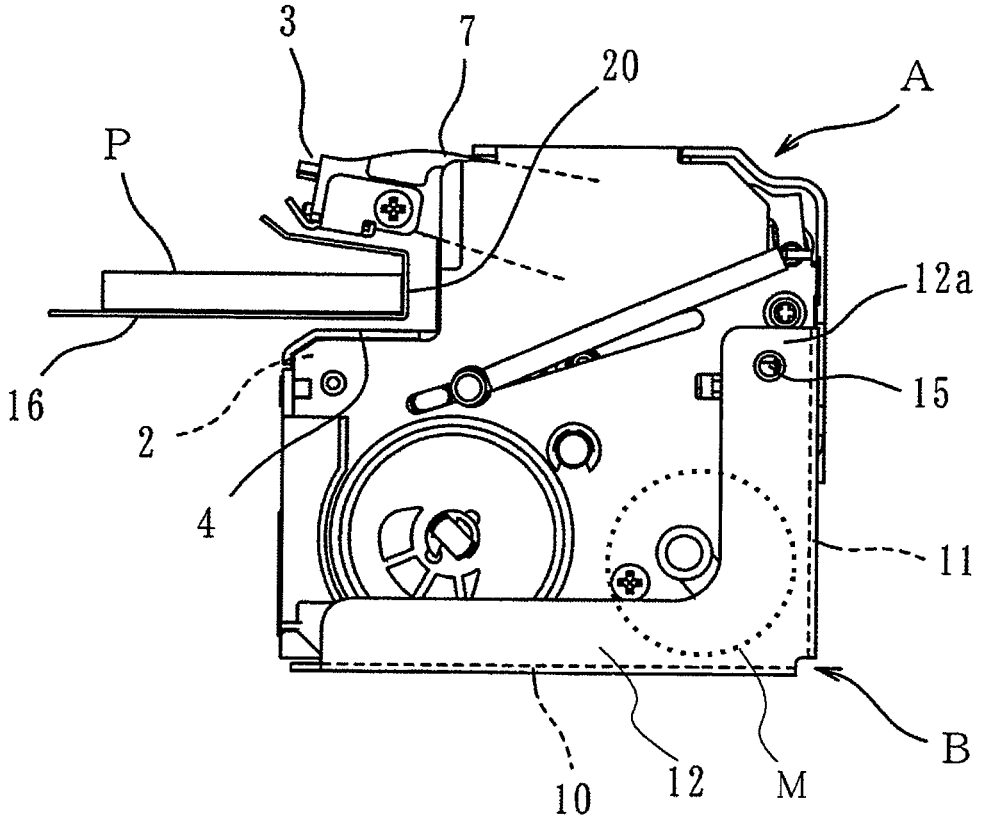
FIG. 2 is a side view showing pertinent portions of the electric stapler of the first exemplary embodiment in a standby state.

As shown in FIG. 2, an electric motor M for driving both the driver unit 2 and the clincher unit 3 is disposed within the stapler main body 1.

In the above configuration, the sheets are fed through a space between the driver unit 2 and the clincher unit 3 and is put on the table 4. Then, when a power is turned ON, the drive link 7 is swung downward to come close to the table 4, and then sheets P are clamped between the table 4 and the drive link 7. Then, the staple is driven out from the driver unit 2, and then the staple is pierced through the sheets P to protrude upward. Then, the staple is clinched along a surface of the sheets P by the movable clincher of the clinching portion 8, and thus the stapling action is ended. After the stapling action is ended, the drive link 7 is moved to return to an upper standby position again.

As shown in FIG. 2, the base B serves as the member to which the stapler main body 1 is fitted, and an L-shaped base bracket 12 is formed on both sides of a bottom plate 10 and a rear plate 11. A top end of an upright portion 12*a* of the base bracket 12 is folded inwardly like a U-shape. The stapler main body 1 is arranged on the bottom plate 10. A bearing hole (not shown) is formed on the side surface of the stapler main body 1 in the height position substantially the same as the table 4 on the opposite side to the table 4 in the front-rear direction. A rotating shaft 15 (see FIG. 2) is fitted into this bearing hole and a bearing hole 13 that is provided to a folded portion 14 at the top end of the upright portion of the base bracket 12. (The rotating shaft 15 structures a supporting mechanism for supporting the stapler main body 1 so as to be displacable with respect to the base B.) Accordingly, the stapler main body 1 can be displaced with respect to the base B so as to turn vertically around the rotating shaft 15.

A reference numeral 16 denotes a guide plate that is used to feed the sheets P onto the table 4 of the electric stapler A and then staple them together. A part of the guide plate 16 is omitted herein from the illustration. This guide plate 16 is normally provided to a paper eject port of the paper processing equipment (the copying machine or the printer, or the like), and the copied or printed sheets of paper are stacked on the guide plate 16 via the sorter. A paper loading portion (loading surface) 17 is formed on the guide plate 16, and an opening portion 18 used to staple the sheets P is formed on the top end side by notching the paper loading portion 17. Top ends of the opening portion 18 on both sides are folded back by an almost right angle, and a top end wall 20 acts as a receiving plane that the edge of the sheets P hits.

The folded portion of the guide plate 16 is arranged between the driver unit 2 of the stapler main body 1 and the clincher unit 3. The paper loading portion 17 of the guide plate 16 is arranged in a position that is higher than the table 4 by one step. Therefore, the opening portion 18 of the guide plate 16 faces to the table 4 on different levels, and also the electric stapler A can slide in the right/left direction with respect to the fixed guide plate 16. As a result, the sheets P can be stapled in different positions mutually by one electric stapler A.

Figure 3:
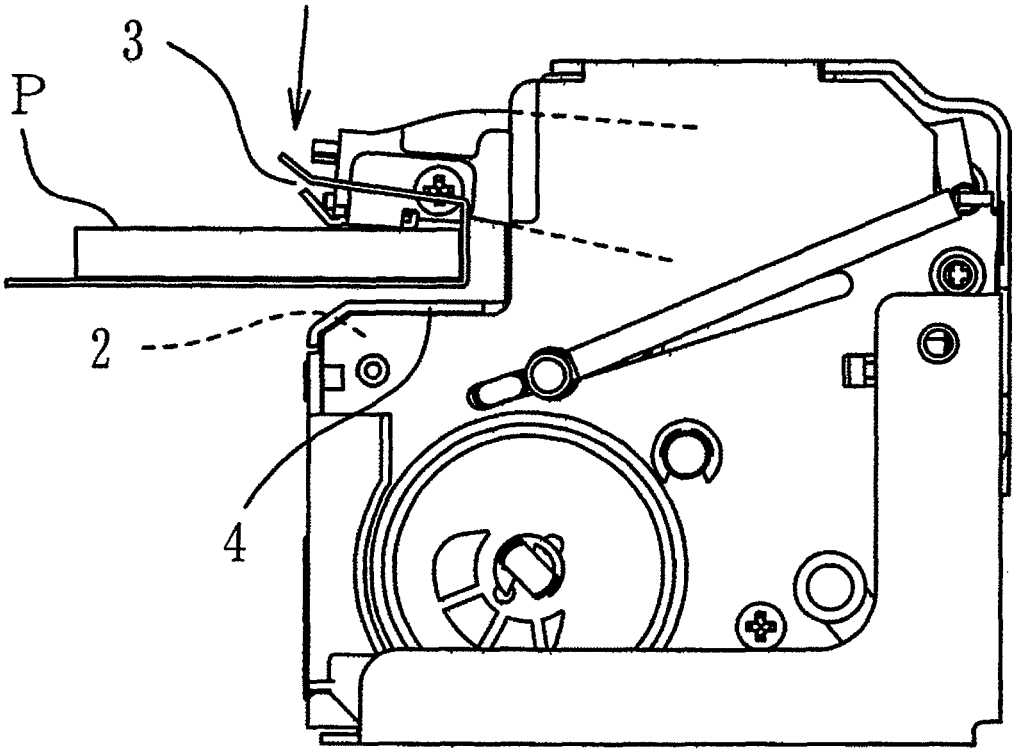
FIG. 3 is a side view showing a state that a clincher unit of the electric stapler of the first exemplary embodiment is pushed against sheets.
Figure 4:
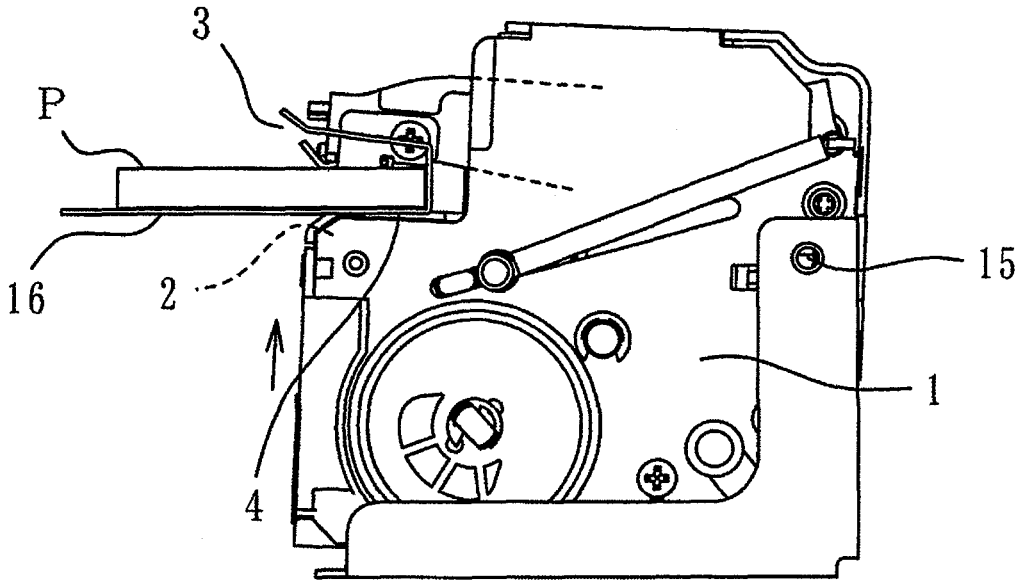
FIG. 4 is a pertinent side view showing a state that a stapler main body is swung/clamped to perform a stapling action after the clincher unit of the electric stapler of the first exemplary embodiment is further pushed against the sheets.

As shown in FIG. 2, a plurality of sheets P are stacked on the guide plate 16 and are fed onto the table 4 of the electric stapler A, and then a power of the electric stapler A is turned ON. At this time, according to the above configuration, as shown in FIG. 3, the drive link 7 of the clincher unit 3 is swung downward to come close to the table 4 of the driver unit 2, and is clamped. In this event, the paper loading portion 17 of the guide plate 16 and the table 4 of the driver unit 2 are positioned on different levels, and thus the bundle of the sheets P is set in a floating state over the table 4. When the bundle of the sheets P is thick and has rigidity, such bundle is not so bent and the sheets P are set in a fixed state. Meanwhile, the drive link 7 further continues to swing, and thus a clamping force is further increased. Therefore, as shown in FIG. 4, the stapler main body 1 equipped with the driver unit 2 is turned/displaced around the rotating shaft 15 to constitute a substantially coplanar plane to the loading surface of the guide plate 16 of the table 4. Thus, the sheets P are clamped surely between the driver unit 2 and the clincher unit 3. That is, the table 4 moves between a position where the table 4 is positioned in a different level from the loading surface 17 (that is, first position=a position where the table 4 positions in a different level from one of surfaces of the sheets P) and a position where the table 4 and the loading surface 17 constitute a substantially coplanar plane (that is, second position=a position where the table 4 and said one of surfaces of the sheets P constitute a substantially coplanar plane), in accordance with the displacement movement of the stapler main body 1. On this occasion, in accordance with the displacement movement of the stapler main body 1, a whole of the electric motor M is also displaceable with respect to the base B. In addition, the displacement movement of the stapler main body 1 is powered by the electric motor M. Then, the staple is driven out from the driver unit 2, and then the staple is pierced through the sheets P to protrude upward. Then, the staple is clinched along the surface of the sheets P by the movable clincher of the clinching portion 8, and thus the stapling action is ended. After the stapling action is ended, the drive link 7 is moved to return to the upper standby position again, as shown in FIG. 1, and thus the stapler main body 1 is also turned downward to return to the standby position.

As described above, the sheets P are clamped surely between the driver unit 2 and the clincher unit 3. Therefore, the stapling action can be performed smoothly and surely.

Also, the position of the rotating shaft 15 is provided in the substantially same height position as the table 4. Therefore, respective positions of the clinching portion 8 and the driver unit are seldom displaced even when the stapler main body 1 is turned/displaced, and thus the stapling action can be performed without fail.

Also, since the structure used to turn/displace the stapler main body is simple and achieved by utilizing the stapling action, another motor and another mechanism are not newly needed. As a result, a cost can be suppressed low, and also a size reduction of the overall stapler is not spoiled.

Second Exemplary Embodiment

Further, any displacement of the stapler main body 1 may be employed if such displacement can move vertically the stapler main body by utilizing the stapling action. The displacing mode is not always limited to the displacement that is caused by utilizing the clamping action. For example, according to a second exemplary embodiment, as shown in FIG. 5 to FIG. 9, the operations of a driving shaft and a cam provided to the stapler main body 1 may be utilized.

More particularly, a driving shaft 21 provided to the stapling side of the driver unit 2 is coupled to an output shaft of an electric motor in operation. An operation mode of the driving shaft 21 is set such that one cycle required until the stapler main body 1 returns to the standby state again after the stapling action is finished from the standby state is executed by one turn. For example, a circular cam 22 is provided to the driving shaft 21, and an end portion of the drive link 7 of the clincher unit 3 is engaged with a cam groove (not shown) formed on the inner side of the cam. The stapling steps in one cycle are constructed such that, while the drive link 7 is caused by the cam groove during one turn of the cam 22 to swing downward from the upper standby position and then return to the upper standby position, the clincher unit 3 is shifted downward from the standby state, then the stapling action is performed, and then the clincher unit 3 is returned to the standby state. Also, the driver unit 2 is constructed such that this driving portion is displaced from the standby position to the staple driving position and then the standby position during one turn of the driving shaft 21. For this purpose, a chord portion may be formed notching a part of an outer peripheral surface of the circular cam 22, a chord/circular arc portion 23 having a circular arc may be formed in the center of the chord portion, and a cam follower 24 may be provided in the position corresponding to the cam 22 on the bottom plate 10 of the base B.

Figure 5:
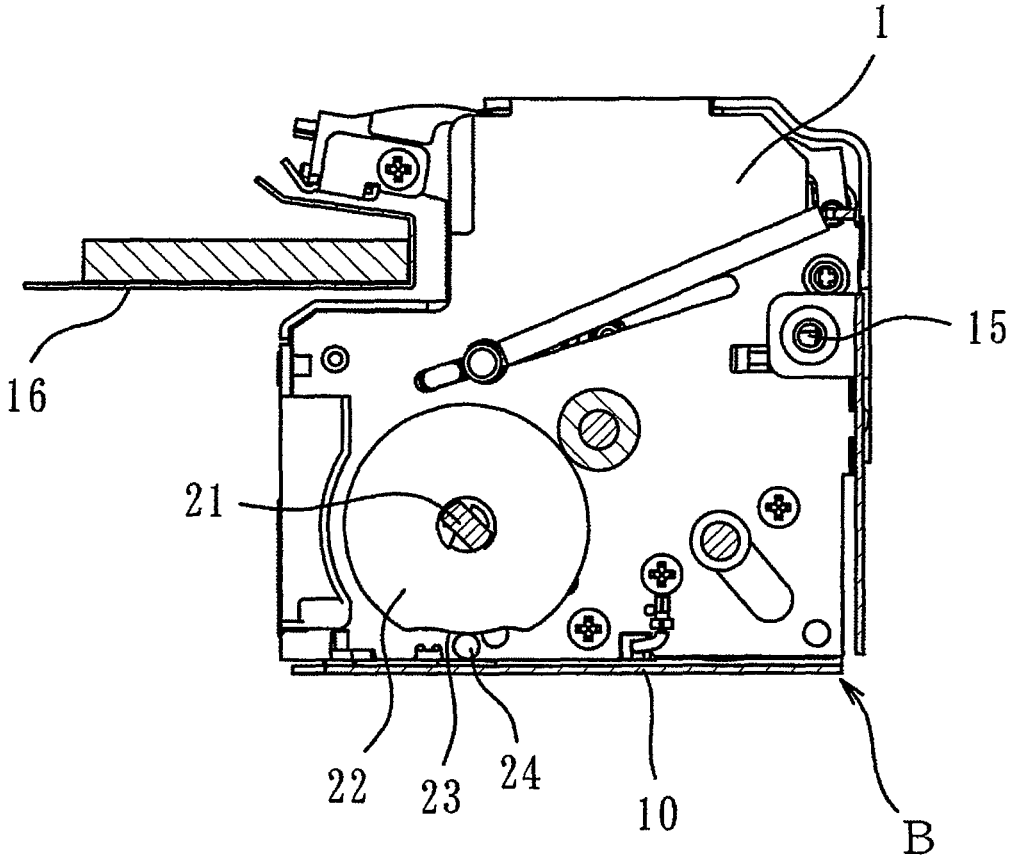
FIG. 5 is a pertinent side view of an electric stapler of a second exemplary embodiment in a standby state.
Figure 6:
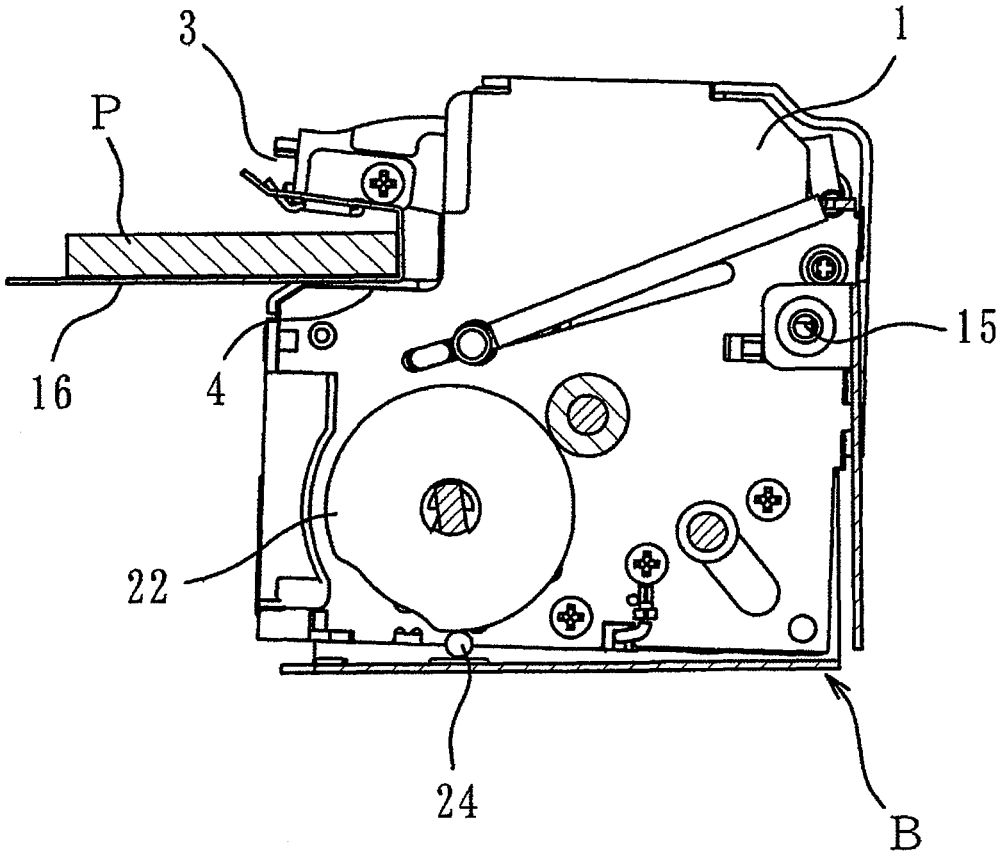
FIG. 6 is a pertinent side view of the electric stapler of the second exemplary embodiment in a state that the stapler main body is displaced.
Figure 7:
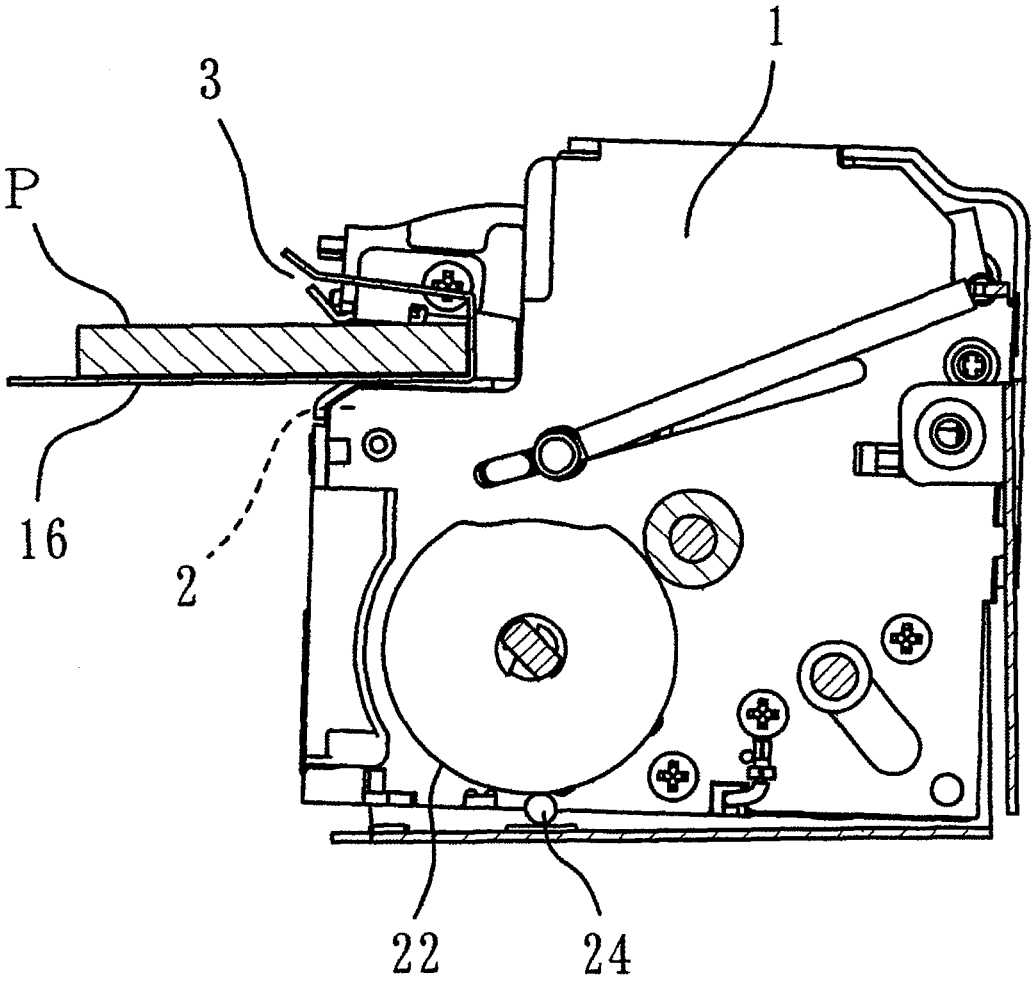
FIG. 7 is a pertinent side view of the electric stapler of the second exemplary embodiment in a state that a bundle of sheets is clamped.

In the above configuration, in the standby state, as shown in FIG. 5, the cam follower 24 is set to engage with the chord/circular arc portion 23. In the stapling action, as shown in FIG. 6, the cam 22 is turned together with the driving shaft 21 and its outer peripheral surface is caused to run up onto the cam follower 24, and thus the stapler main body 1 is pushed up. Therefore, the stapler main body 1 is turned/displaced around the rotating shaft 15 on the rear side, so that the table 4 and the sheets loading surface of the guide plate 16 constitute a substantially coplanar plane. Then, as shown in FIG. 7, the sheets P are clamped between the clincher unit 3 and the table 4. Then, the staple is driven out from the driver unit 2, and then the staple is pierced through the sheets P to protrude upward. Then, the staple is clinched along the surface of the sheets P by the movable clincher of the clinching portion 8, and thus the stapling action is ended. After the stapling action is ended, as shown in FIG. 5, the drive link 7 is moved to return to an upper standby position again, and also the stapler main body 1 is turned downward to return to the standby state. Because the driving shaft 21 executes the stapling action in one cycle every one turn, the stapler main body 1 can be turned/displaced while causing the outer peripheral surface of the cam 22 to engage with the cam follower 24 at the timing at which the drive link 7 of the clincher unit 3 is swung downward to clamp the sheets P. After the stapling action is ended, the cam follower 24 may engage with the chord/circular arc portion 23 again and may return to the position of the standby state.

In this case, instead of the cam 22 that is provided to the clincher unit 3 or the driver unit 2 to drive the clincher or the driver, another cam may be provided to the driving shaft 21.

Third Exemplary Embodiment

Figure 8:
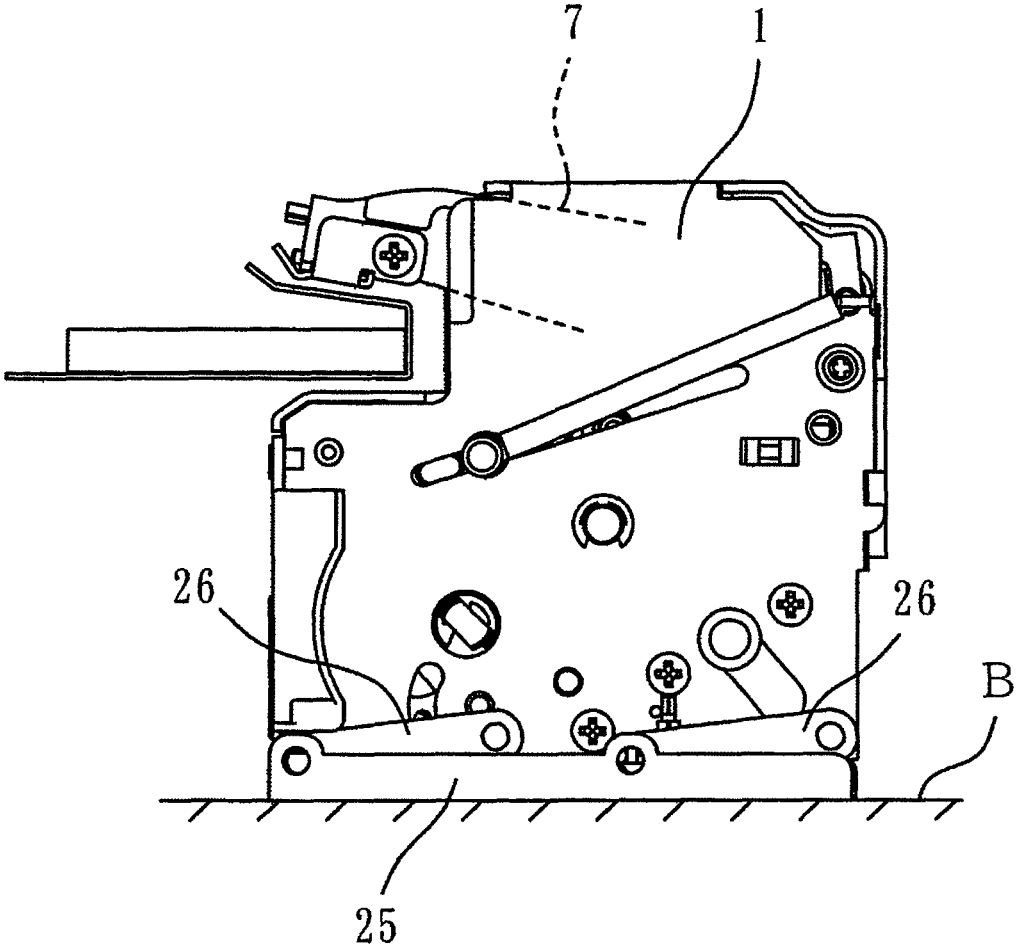
FIG. 8 is a pertinent side view of an electric stapler of a third exemplary embodiment in a standby state.

The displacement of the stapler main body 1 is not limited to the displacement that is given by the turning. For example, in a third exemplary embodiment, as shown in FIG. 8, the stapler main body 1 may be displaced by means of a parallel translation. More particularly, a quadric crank link mechanism consisting of a base link 25 and two equilong links 26 provided turnably to the base link 25 respectively is constructed on the base B by providing the end portions of two links turnably to the lower portion of the side surface of the stapler main body 1.

Figure 9:
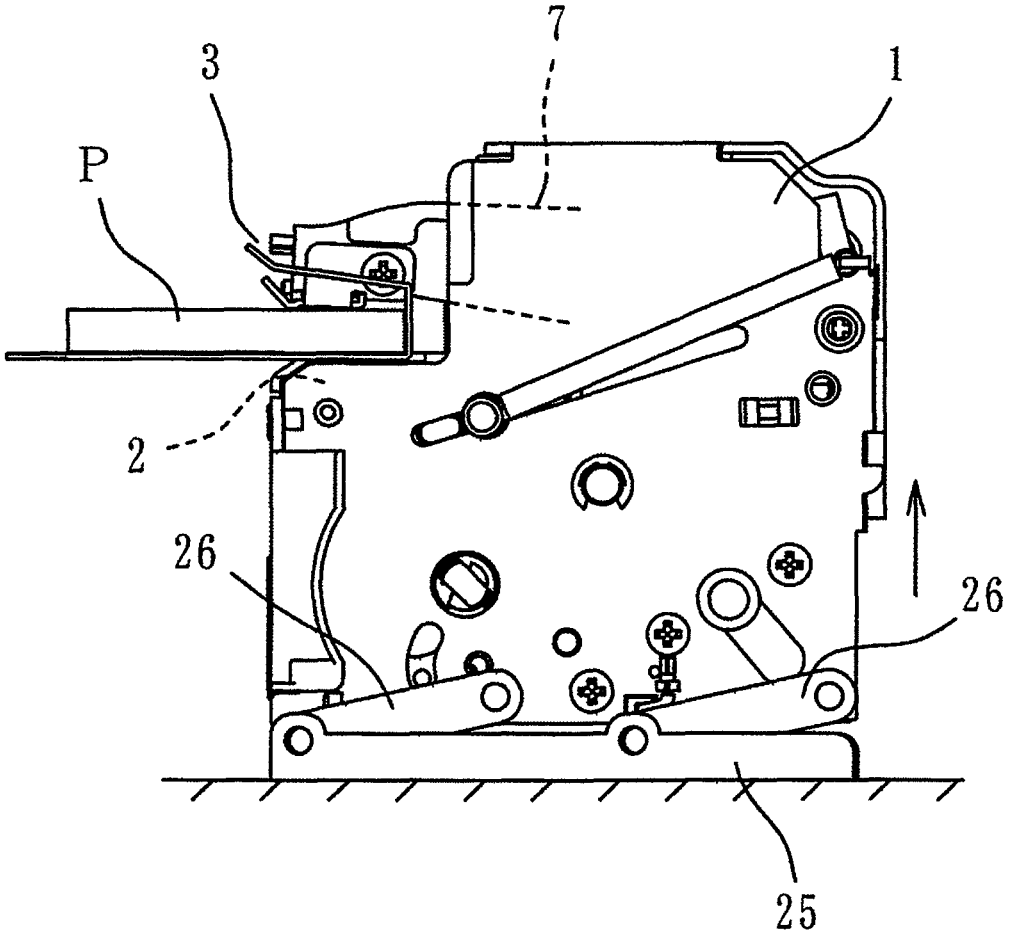
FIG. 9 is a pertinent side view of the electric stapler of the third exemplary embodiment in a state that the stapler main body is displaced and the bundle of sheets is clamped.

According to the above configuration, as shown in FIG. 9, in the stapling action, the stapler main body 1 is displaced by the action of the link mechanism to move in parallel upwardly. Therefore, the table 4 is moved upward, and the table 4 and the sheets loading surface of the guide plate 16 constitute a substantially coplanar plane. Thus, the sheets P are clamped surely between the driver unit 2 and the clincher unit 3. Then, the staple is driven out from the driver unit 2, and then the staple is pierced through the sheets P to protrude upward. Then, the staple is clinched along the surface of the sheets P by the movable clincher of the clinching portion 8, and thus the stapling action is ended. After the stapling action is ended, the drive link 7 is moved to return to an upper standby position again, and also the stapler main body 1 is moved downward to return to the standby state.

In this case, in order to cause the stapler main body 1 to displace easily, a plate spring, a coil spring, or the like may be provided between the base B and the stapler main body 1 or a guide may be provided such that the stapler main body 1 can move vertically to the base B.

Fourth Exemplary Embodiment

Figure 10:
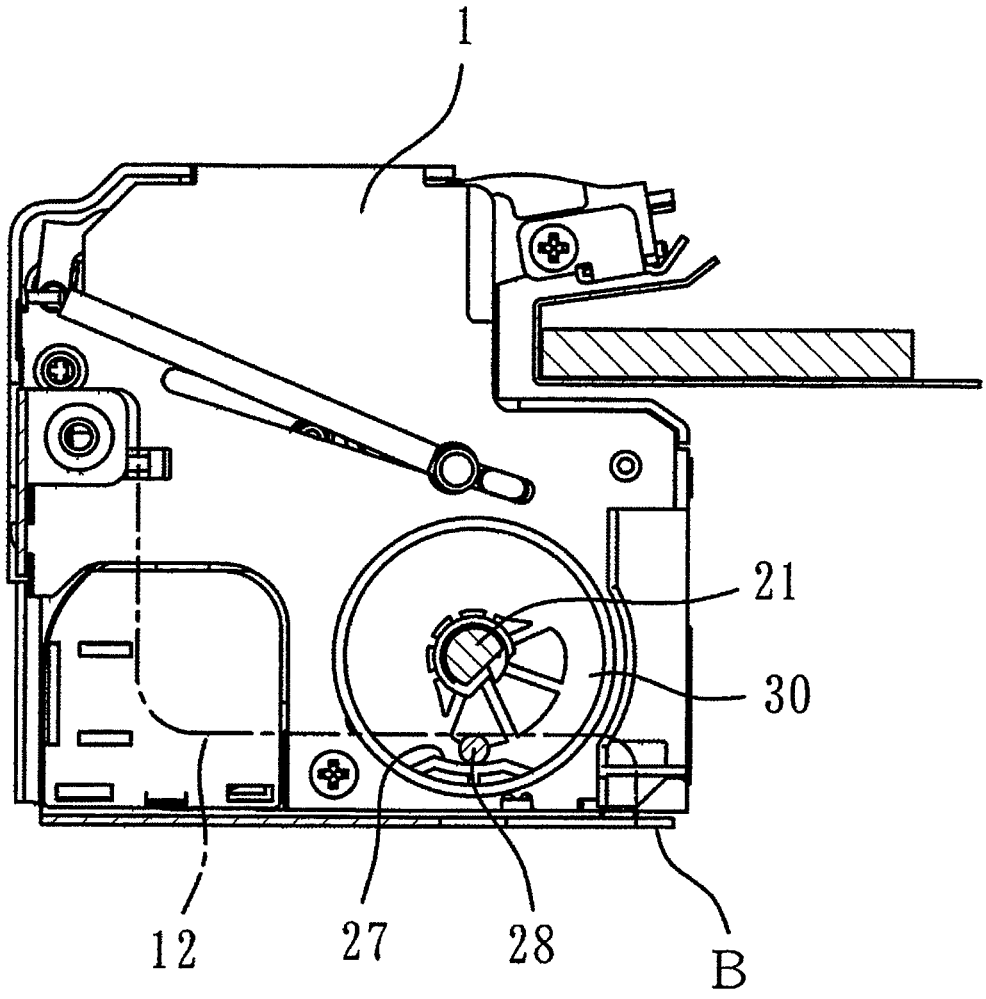
FIG. 10 is a pertinent side view of an electric stapler of a forth exemplary embodiment in a standby state.

Meanwhile, in a situation that the stapler main body 1 can be displaced with respect to the base B, the stapler main body 1 may move inadvertently when the staple cartridge is exchanged or the stapler main body 1 is inclined. Therefore, it is preferable that, when the stapler main body 1 stays in the standby state, this main body should be kept in a stable state. For this purpose, according to a forth exemplary embodiment of the invention, a mechanism including a circular cam 30 (a second cam 30) and a cam follower 28 (a second cam follower 28) may be added to the structure of any one of the first to third exemplary embodiments. As shown in FIG. 10, the circular cam 30 used to swing the other drive link (the drive links are provided as a pair on the right and left sides) like the cam 22 is provided on the opposite side to the above cam 22 that is provided to one end of the driving shaft 21 of the stapler main body 1. Therefore, a protruded circular edge is formed on the outer peripheral edge of the cam 30 as an internal cam, and a projection portion 27 protruded from the inner peripheral surface of the circular edge toward the inner side is formed on a part of the internal cam. In contrast, the cam follower 28 is provided to the base bracket 12 in the position corresponding to the inner side of the circular edge. Then, in the standby state, the cam follower 28 is set to engage with the projection portion 27.

Figure 11:
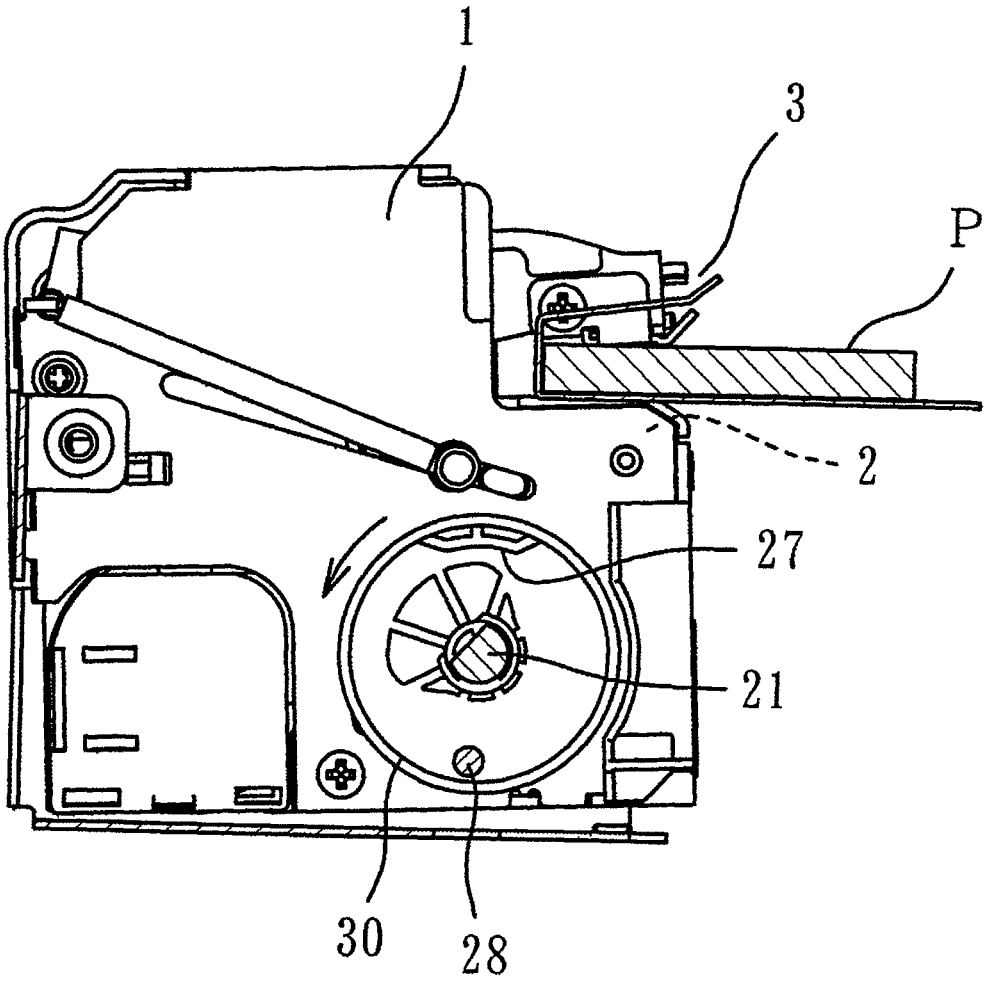
FIG. 11 is a pertinent side view of the electric stapler of the forth exemplary embodiment in a state the stapler main body is set in a displaceable state.

According to the above configuration, when the clamping is released after the stapling action is ended, the projection portion 27 of the cam 30 is engaged with the bottom of the cam follower 28, and the stapler main body 1 is brought into the standby state. At this time, the stapler main body 1 cannot be displaced and is set in a stable state. In the stapling action, as shown in FIG. 11, the cam 22 is turned together with the driving shaft 21 and the cam follower 28 is released from the projection portion, so that the stapler main body 1 is set in a displaceable state. After the stapling action is finished, the projection portion 27 of the cam 30 is engaged with the bottom of the cam follower 28 again. Thus, the upward displacement of the stapler main body 1 is restricted, and the stapler main body 1 is brought into the stable state. Since the driving shaft 21 performs the stapling action in one cycle every turn, the stapler main body 1 can be stabilized by engaging the projection portion 27 of the cam 30 with the top of the cam follower 28 at the timing at which the drive link 7 returns to the standby position after the stapling action is ended.

Further, in the structure of any one of first to fourth exemplary embodiments, the staple main body may be constructed such that the clincher unit and the driver unit are arranged oppositely in the vertical direction.

DESCRIPTION OF REFERENCE NUMERALS AND SIGNS

A electric stapler; B base; P sheets; 1 stapler main body; 2 driver unit; 3 clincher unit; 4 table; 5 head portion; 16 guide plate; 18 opening portion

What is claimed is:

1. An electric stapler comprising:

a base;

a stapler main body arranged on the base and including a driver unit having a driver for driving a staple to pierce through sheets of paper, a clincher unit having a clincher for clinching the driven staple, and a table provided on one of the driver unit and the clincher unit and on which the sheets are supported in a direction in which the sheets are stacked during a stapling action; and a supporting mechanism configured to support the stapler main body to be displaceable with respect to the base, wherein the table is configured to be movable between a first position and a second position spaced apart from the first position in a direction in which the driver drives the staple, in accordance with a displacement of the stapler main body with respect to the base, wherein the stapler main body is displaced together with said one of the driver unit and the clincher unit by an increase in a clamping force of a clamping action in which the sheets are clamped by bringing the other of the driver unit and the clincher unit close to said one of the driver unit and the clincher unit in the stapling action, such that the table moves to the second position, and wherein the stapler main body is supported to displace with respect to the base in a manner of a parallel translation in a direction in which the driver drives the staple toward the sheets.

2. The electric stapler according to claim 1, wherein, at said first position, the table positions in a different level from one of surfaces of the sheets in a space between the driver unit and the clincher unit, and at said second position, the table and said one of surfaces of the sheets constitute a substantially coplanar plane.

3. The electric stapler according to claim 1, wherein the electric stapler is provided in a paper processing equipment, at said first position, the table positions in a different level from a loading surface on which the sheets are loaded and which is formed on a guide plate provided in the paper processing equipment, and at said second position, the table and the loading surface constitute a substantially coplanar plane.

4. The electric stapler according to claim 1, wherein the base is fixed on a frame member provided in a paper processing equipment.

5. The electric stapler according to claim 1, wherein the base is disposed on a frame member provided in a paper processing equipment so that the base is movable along a direction of an edge of the sheets.

6. The electric stapler according to claim 1, wherein the base is disposed on a frame member provided in a paper processing equipment so that the base is movable in a direction close-toward/apart-from an edge of the sheets.

7. The electric stapler according to claim 1, wherein an electric motor configured to drive both the driver unit and the clincher unit is mounted within the stapler main body, wherein a displacement movement of the stapler main body with respect to the base is powered by said electric motor, and the electric motor is arranged within the stapler main body so that a whole of the electric motor is also displaceable with respect to the base in accordance with the displacement movement of the stapler main body.

8. The electric stapler according to claim 1, wherein the stapler main body is configured to displace with respect to the base in accordance with the stapling action of the driver unit or the clincher unit.

9. The electric stapler according to claim 1, wherein the stapler main body is displaced together with the driver unit by the increase in the clamping force of the clamping action in which the sheets are clamped by bringing the clincher unit close to the driver unit in the stapling action, such that the table moves to the second position.

10. An electric stapler comprising:

a base;

a stapler main body arranged on the base and including a driver unit having a driver for driving a staple to pierce through sheets of paper, a clincher unit having a clincher for clinching the driven staple, and a table provided on one of the driver unit and the clincher unit and on which the sheets are supported in a direction in which the sheets are stacked during a stapling action; and a supporting mechanism configured to support the stapler main body to be displaceable with respect to the base, wherein the table is configured to be movable between a first position and a second position spaced apart from the first position in a direction in which the driver drives the staple, in accordance with a displacement of the stapler main body with respect to the base, wherein a projection portion is formed on a cam arranged on a driving shaft provided on said one of the driver unit and the clincher unit on which the table is provided, wherein a cam follower that is engagable with the projection portion is provided to the base, and wherein the cam follower is engaged with the projection portion in a standby state to restrict a displacement of the stapler main body.

11. An electric stapler comprising:

a base;

a stapler main body arranged on the base and including a driver unit having a driver for driving a staple to pierce through sheets of paper, a clincher unit having a clincher for clinching the driven staple, and a table provided on one of the driver unit and the clincher unit and on which the sheets are supported in a direction in which the sheets are stacked during a stapling action;

a supporting mechanism configured to support the stapler main body to be displaceable with respect to the base;

a cam arranged on a driving shaft provided on said one of the driver unit and the clincher unit on which the table is provided; and a cam follower provided on the base and engaged with the cam, wherein the table is configured to be movable between a first position and a second position spaced apart from the first position in a direction in which the driver drives the staple, in accordance with a displacement of the stapler main body with respect to the base, wherein the stapler main body is displaced with respect to the base by rotating the cam to change a distance between the driving shaft and the cam follower, such that the table moves to the second position, wherein a second cam is arranged on the driving shaft, wherein a projection portion is formed on the second cam, wherein a second cam follower that is engagable with the projection portion is provided to the base, and wherein the second cam follower is engaged with the projection portion in a standby state to restrict a displacement of the stapler main body.

* * * * *